US011617695B1

(12) United States Patent
Xia

(10) Patent No.: US 11,617,695 B1
(45) Date of Patent: Apr. 4, 2023

(54) FOOTREST STRAP FOR A WHEELCHAIR

(71) Applicant: Robert Xianhe Xia, Atlanta, GA (US)

(72) Inventor: Robert Xianhe Xia, Atlanta, GA (US)

( * ) Notice: Subject to any disclaimer, the term of this patent is extended or adjusted under 35 U.S.C. 154(b) by 0 days.

(21) Appl. No.: 17/954,802

(22) Filed: Sep. 28, 2022

(51) Int. Cl.
*A61G 5/12* (2006.01)
*A61G 5/10* (2006.01)

(52) U.S. Cl.
CPC ..... *A61G 5/10* (2013.01)

(58) Field of Classification Search
CPC ..... A61G 5/10; A61G 7/1098; A61G 5/12; A61G 5/127; A61G 5/128
USPC ..... 280/727
See application file for complete search history.

(56) References Cited

U.S. PATENT DOCUMENTS 4,243,265 A * 1/1981 Hanik ..... A61G 5/12 128/893
4,463,985 A * 8/1984 Kynast ..... A61G 5/12 297/423.1
4,595,212 A 6/1986 Haury et al.
4,721,321 A 1/1988 Haury et al.
4,768,797 A 9/1988 Friedrich
4,805,925 A 2/1989 Haury et al.
4,846,744 A * 7/1989 Love ..... B63B 32/45 441/74
5,033,736 A * 7/1991 Hirschfeld ..... A61H 1/0214 601/36
5,052,128 A * 10/1991 Lonardo ..... A61F 5/3761 36/110
5,379,725 A * 1/1995 Roberson ..... A47D 15/006 119/857
5,401,045 A * 3/1995 Foerster ..... A61G 5/12 297/423.37
5,409,247 A 4/1995 Robertson et al.
5,438,722 A 8/1995 Jayamanne
5,775,722 A * 7/1998 Moore ..... A62B 99/00 280/727
5,957,474 A 9/1999 Mundy et al.
6,237,520 B1 * 5/2001 Sisseren ..... B63B 32/45 114/39.19
6,971,190 B2 * 12/2005 Runyan ..... A43B 3/105 36/11.5
7,121,572 B1 * 10/2006 Jaffe ..... A61G 5/12 128/882
7,334,275 B1 * 2/2008 Kirkwood ..... A61F 5/3715 5/81.1 R
7,832,807 B2 * 11/2010 Shickle ..... A61G 5/10 297/485
8,950,773 B2 * 2/2015 Wright ..... A61G 5/12 280/291
9,549,862 B2 * 1/2017 Plotnizky ..... A63B 21/023
(Continued)

*Primary Examiner* — James A Shriver, II
*Assistant Examiner* — Hilary L Johns

(57) ABSTRACT

A footrest strap usable with a footrest of a wheelchair has a body portion having a first end portion, a second end portion, and a center portion. The footrest strap also has a male interlocking member formed at the first end portion, a female interlocking member formed at the second end portion, where the male interlocking member and the female interlocking member are adapted to form an interlocking means. Moreover, the footrest strap has a receptacle formed on the body portion at an offset position that is away from the center portion. The receptacle is formed with a first end and a second end that is opened and adapted for allowing a supporting screw of the footrest to be introduced into a space therein.

15 Claims, 8 Drawing Sheets

(56) References Cited

U.S. PATENT DOCUMENTS

| | | | | |
|---|---|---|---|---|
| 10,182,956 | B2 | 1/2019 | Stryker et al. | |
| 11,173,082 | B2 | 11/2021 | Huprich | |
| 2004/0026901 | A1* | 2/2004 | Yann | B60R 21/213 280/727 |
| 2006/0097562 | A1* | 5/2006 | Hiruta | A61G 5/1054 297/467 |
| 2008/0272573 | A1* | 11/2008 | Hiatt | A61G 5/12 280/304.1 |
| 2009/0194976 | A1* | 8/2009 | Lane | A61G 5/10 280/727 |
| 2009/0315385 | A1* | 12/2009 | Shickle | A61G 5/10 297/468 |
| 2010/0095459 | A1* | 4/2010 | Lambert | A61G 5/1043 5/653 |
| 2010/0137750 | A1* | 6/2010 | Grail | A61F 5/3769 601/1 |
| 2010/0171358 | A1* | 7/2010 | Hull | A47D 15/006 297/481 |
| 2010/0289230 | A1* | 11/2010 | Duarte | A63C 17/1436 280/11.19 |
| 2011/0084354 | A1* | 4/2011 | Honda | H01L 29/0657 257/493 |
| 2017/0340494 | A1* | 11/2017 | Van de Wal | B60B 33/00 |
| 2021/0016079 | A1* | 1/2021 | Ekelem | A61N 1/0452 |
| 2022/0280364 | A1* | 9/2022 | Hayes | A61G 5/1094 |

* cited by examiner

FOOTREST STRAP FOR A WHEELCHAIR

CROSS-REFERENCE TO RELATED PATENT APPLICATION

This application relates to a U.S. design patent application, entitled as "Footrest Strap for a Wheelchair", which is concurrently filed in the U.S. Patent and Trademark Office.

FIELD OF THE INVENTION

The present invention relates generally to a footrest strap for a wheelchair, and more particularly to a footrest strap that can be utilized to replace defective or tired down footrest straps associated with wheelchairs in use.

BACKGROUND OF THE INVENTION

There exist several commercially available wheelchairs for individuals in need. In general, wheelchairs are of a conventional design that has simply been reinforced, such as by the use of heavier tubing, additional gussets, additional cross bracing, larger diameter axles, heavy duty tires, and similar strengthening methods. In manufacturing these products, a manufacturer does not substantially change the wheelchair design, i.e., the location of the seat and back in relation to the location of front and rear wheels, or the structural design of the wheelchair.

The "wheelchair footrest heel strap" is a neglected component of a wheelchair footrest and the wheelchair as a whole. The piece is designed as a contraption to allow the person sitting in the wheelchair to relax their legs and feet and lean back while their feet are supported. Currently, the most widely used foot or heel straps have one end screwed into the footrest, while the other is glued or otherwise fixed to the metal support beam protruding from the footrest and connecting to the rest of the wheelchair. Because of the frequent interactions between the heel of a user with the heel strap, the heel strap was often consumed and worn before other metal parts of the wheelchair do, which then needs repair and/or replacement.

However, problems arise when considering the ease of repair and replacement. For a conventional heel strap used in a wheelchair, the heel strap cannot be replaced without unscrewing the end bolted into the footrest and cutting off the other end connected to the metal bar. Indeed, removing the strap in such manner is inefficient and tedious. Moreover, such a strap cannot be reused after it is removed—one end has to be severed before being removed, which results in additional cost of labor and materials.

Therefore, a heretofore unaddressed need exists in the art to address the aforementioned deficiencies and inadequacies.

SUMMARY OF THE INVENTION

In one aspect of the present invention, a footrest strap usable with a footrest of a wheelchair is provided, wherein the footrest has a plate, a supporting pole, and a supporting screw across the plate from the supporting pole.

The footrest strap has a body portion having a first end portion, a second end portion, and a center portion that is between the first end portion and the second end portion. The footrest strap also has a male interlocking member formed at the first end portion, a female interlocking member formed at the second end portion, wherein the male interlocking member and the female interlocking member are adapted to form an interlocking means.

Moreover, the footrest strap has a receptacle formed on the body portion at an offset position that is away from the center portion and between the center portion and the second end portion. The receptacle is formed with a first end and a second end, wherein the second end is opened and adapted for allowing the supporting screw to be introduced through the opening formed at the second end to be introduced into a space inside the receptacle when in use.

Furthermore, the footrest strap has a first fastening member formed on the body portion between the first end portion and the offset position, and a second fastening member formed on the body portion between the second end portion and the offset position, wherein the first fastening member and the second fastening member are positioned complimentarily to each other such that when in use the first fastening member and the second fastening member are fastened to each other.

The footrest strap optionally has a third fastening member formed on the body portion between the first end portion and the first fastening member, and a fourth fastening member formed on the body portion between the second end portion and the second fastening member, wherein the third fastening member and the fourth fastening member are positioned complimentarily to each other such that when in use the third fastening member and the fourth fastening member are fastened to each other.

The first fastening member and the second fastening member are hook-loop fasteners complimentary to each other. The third fastening member and the fourth fastening member are also hook-loop fasteners complimentary to each other. In one embodiment, the hook-loop fasteners are Velcro fasteners.

The body portion is made of a continuous strip of pliable material. The pliable material is fabric, plastic or a combination of them.

The receptacle is formed with the first end either closed or opened. Moreover, the receptacle is formed with a material that is the same as or different from that of the body portion. Furthermore, the receptacle is formed as an integral or separate part of the body portion. In one embodiment, the receptacle is formed with its edges sewn in place to the body portion.

The receptacle also is formed with the first end at a first side of the body portion, and the second end at or adjacent to an opposite second side of the body portion with an offset distance.

The interlocking means is a clip-and-buckle mechanism. In one embodiment, the clip-and-buckle mechanism comprises a protruding member as the male interlocking member and a buckle member as the female interlocking member adapted for coupling with the protruding member.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
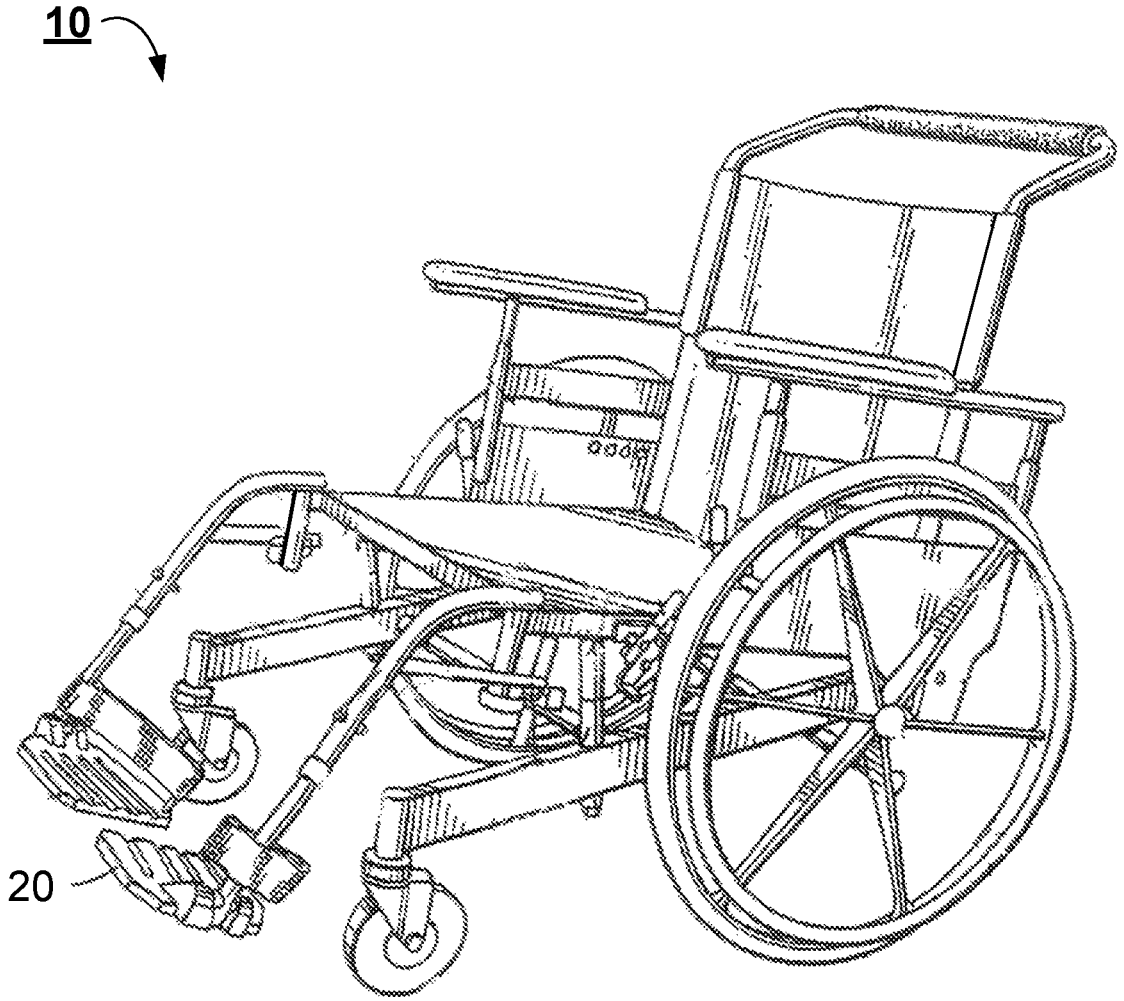
FIG. 1 (Prior Art)
FIG. 1 shows a perspective view of a conventional wheelchair in prior art.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The description will be made as to the embodiments of the present invention in conjunction with the accompanying drawings in FIGS. 1-8. In accordance with the purposes of this invention, as embodied and broadly described herein, this invention, in one aspect, relates to a footrest strap usable with a footrest of a wheelchair.

Figure 2:
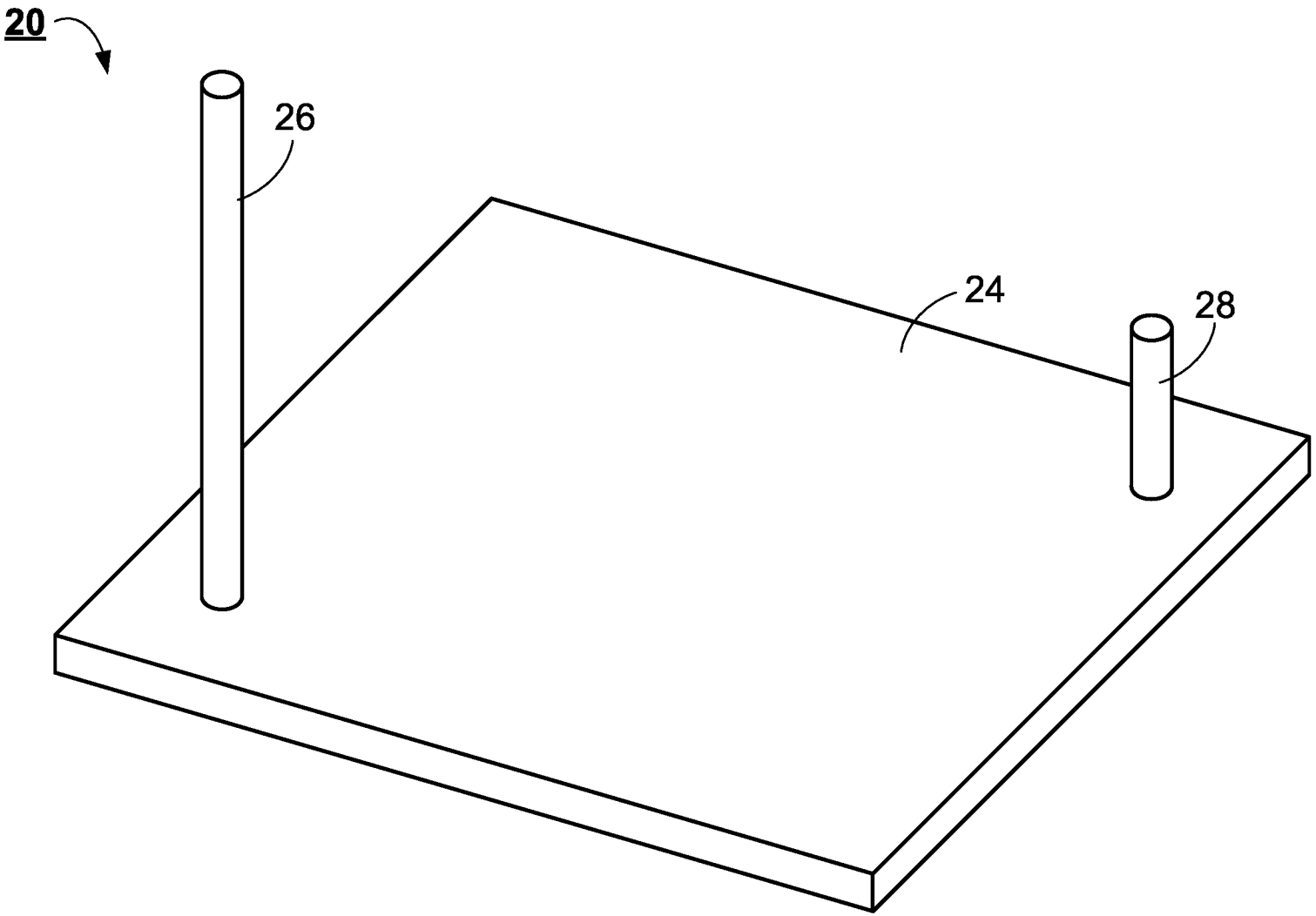
FIG. 2 (Prior Art)
FIG. 2 shows a perspective view of the footrest of the wheelchair as shown in FIG. 1.
Figure 3:
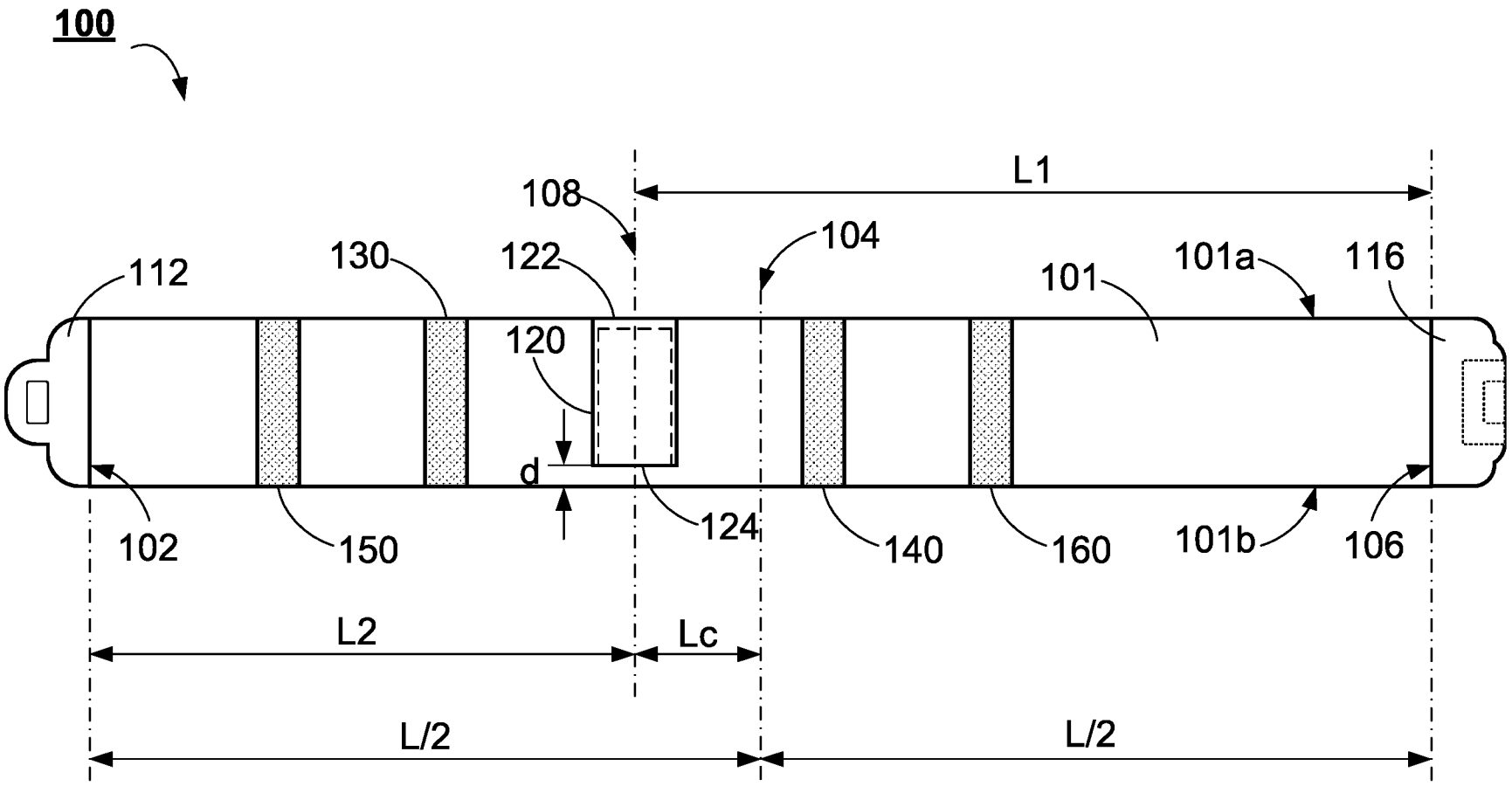
FIG. 3 shows a plain view of the footrest strap according to one embodiment of the present invention.
Figure 4:
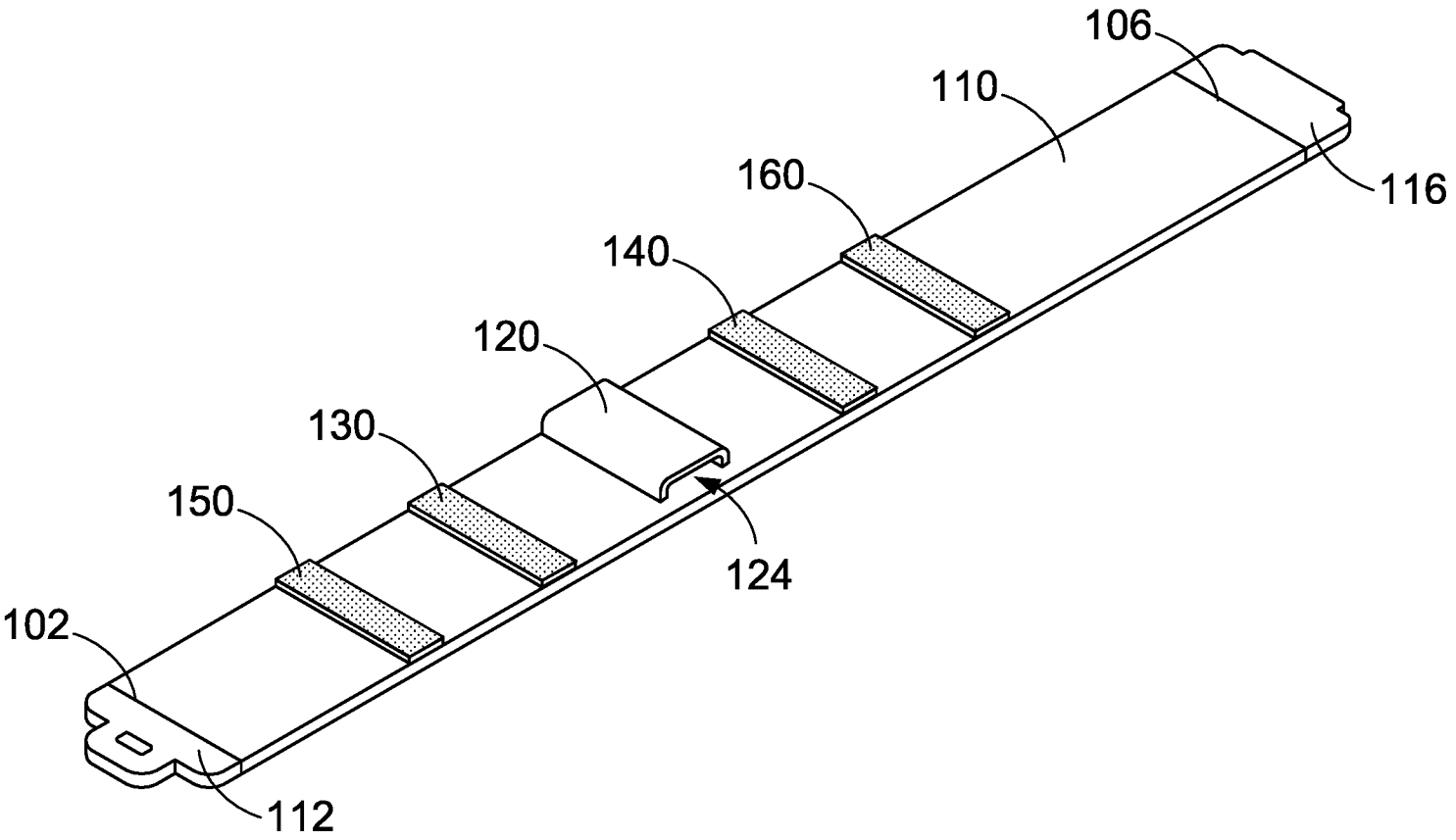
FIG. 4 shows a perspective view of the footrest strap according to one embodiment of the present invention.
Figure 5:
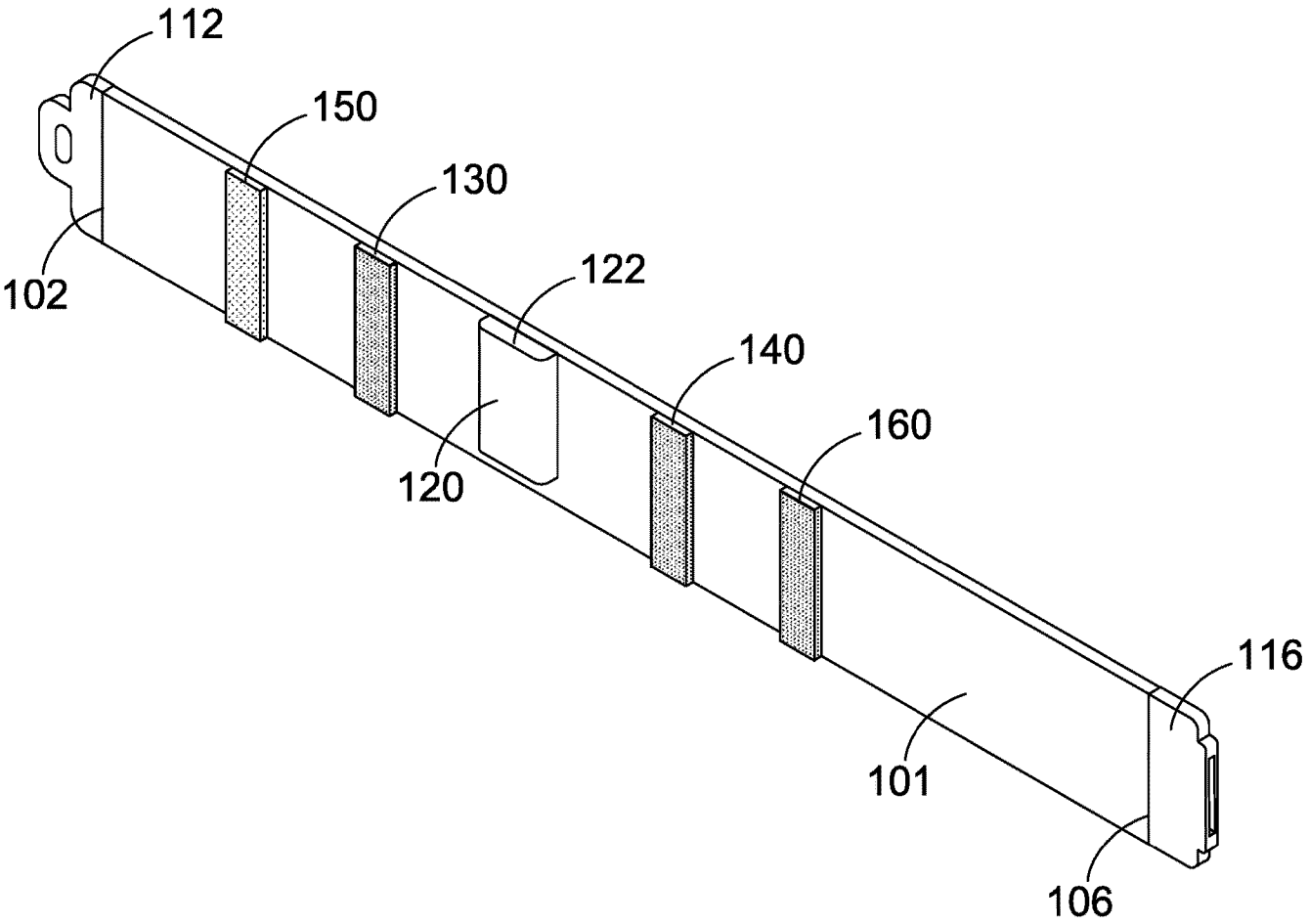
FIG. 5 shows a perspective view of the footrest strap according to one embodiment of the present invention from another viewing angle.

FIG. 1 shows a perspective view of a conventional wheelchair, with which the footrest strap of the present invention can be used, and FIG. 2 shows a perspective view of the footrest of the wheelchair as shown in FIG. 1. As shown in FIG. 1, the wheelchair has two footrests 20 located at the front bottom side thereof, and each footrest 20 has a footrest strap thereon. As shown in FIG. 2, the footrest 20 has a plate 24, a supporting pole 26, and a supporting screw 28 across the plate 24 from the supporting pole 26.

FIGS. 3-8 show the footrest strap 100 according to one embodiment of the present invention. As shown in FIGS. 3-8, referring now to FIG. 3 more specifically, the footrest strap 100 includes a body portion 101, a male interlocking member 112, a female interlocking member 116, a receptacle 120, a first fastening member 130, a second fastening member 140, a third fastening member 150 and a fourth fastening member 160.

The body portion 101 has a first end portion 102, a second end portion 106, and a center portion 104 that is between the first end portion 102 and the second end portion 106. A length of the body portion 101 is L, and a distance from each of the first end portion 102 and the second end portion 106 to the center portion 104 is L/2. In certain embodiments, the body portion 101 is made of a continuous strip of pliable material. For example, the pliable material may be fabric, plastic or a combination of them. In certain embodiments, the body portion 101 has a first side 101*a* and a second side 101*b* opposite to each other.

The male interlocking member 112 is formed at the first end portion 102, and the female interlocking member 116 is formed at the second end portion 106. The male interlocking member 112 and the female interlocking member 116 are adapted to form an interlocking means 110 (see FIG. 6). Either the male interlocking member 112 or the female interlocking member 116 (or both) are adjustably formed or coupled with its corresponding end portion of the body portion 101, such that the interlocking means 110 may be formed in different positions to allow a user to adjust the length of the strap to fit the size of the foot of the user. In certain embodiments, the interlocking means has a snap-on or a clip-and-buckle mechanism. For examples, the clip-and-buckle mechanism includes a protruding member as the male interlocking member 112 and a buckle member as the female interlocking member 116 adapted for coupling with the protruding member. In certain embodiments, the male interlocking member 112 and the female interlocking member 116 may be in the form of other type of detachable fixing structures such as metal or plastic belt clips that can be found in https://www.amazon.com/plastic-belt-clip/s?k=plastic+belt+clip, which is incorporated herein for its entirety by reference.

The receptacle 120 is formed on the body portion 101 at an offset position 108 that is away from the center portion 104 and between the center portion 104 and the second end portion 106. The receptacle 120 has a first end 122 and a second end 124. In certain embodiments, the first end 122 is formed at a first side 101*a* of the body portion 101, and the second end 124 is formed at or adjacent to an opposite second side 101*b* of the body portion 101. The second end 124 is opened (see FIG. 4) and adapted for allowing the supporting screw 28 to be introduced through the opening formed at the second end 124 into a space inside the receptacle 120 in use. In comparison, the first end 122 may be either closed or opened. A distance Lc between the offset position 108 and the center portion 104 is shorter than L/2, and a distance L1 between the offset position 108 and the first end portion 102 is greater than a distance L2 between the offset position 108 and the second end portion 106. In certain embodiments, the receptacle 120 is formed with a material that is the same as or different from that of the body portion 101. In certain embodiments, the receptacle 120 is formed as an integral or separate part of the body portion 101, respectively. For example, the receptacle 120 may be formed with its edges sewn in place to the body portion 101.

The first fastening member 130 is formed on the body portion 101 between the first end portion 102 and the offset position 108. The second fastening member 140 is formed on the body portion 101 between the second end portion 102 and the offset position 108. The first fastening member 130 and the second fastening member 140 are positioned complimentarily to each other such that when in use the first fastening member 130 and the second fastening member 140 are fastened to each other. Similarly, the third fastening member 150 is formed on the body portion 101 between the first end portion 102 and the first fastening member 130. The fourth fastening member 160 is formed on the body portion 101 between the second end portion 102 and the second fastening member 140. The third fastening member 150 and the fourth fastening member 160 are positioned complimentarily to each other such that when in use the third fastening member 150 and the fourth fastening member 160 are fastened to each other. In certain embodiments, using the offset position 108 as a reference position, the first fastening member 130 and the second fastening member 140 are positioned substantially symmetrical to each other, and the third fastening member 150 and the fourth fastening member 160 are positioned substantially symmetrical to each other.

In certain embodiments, the first fastening member 130, the second fastening member 140, the third fastening member 150 and the fourth fastening member 160 are hook-loop fasteners complimentary to each other. In one embodiment, the hook-loop fasteners are Velcro fasteners. In certain embodiments, the footrest strap 100 may include additional fastening members (not shown) provided on the body portion 101 to be complimentary to each other.

Figure 6:
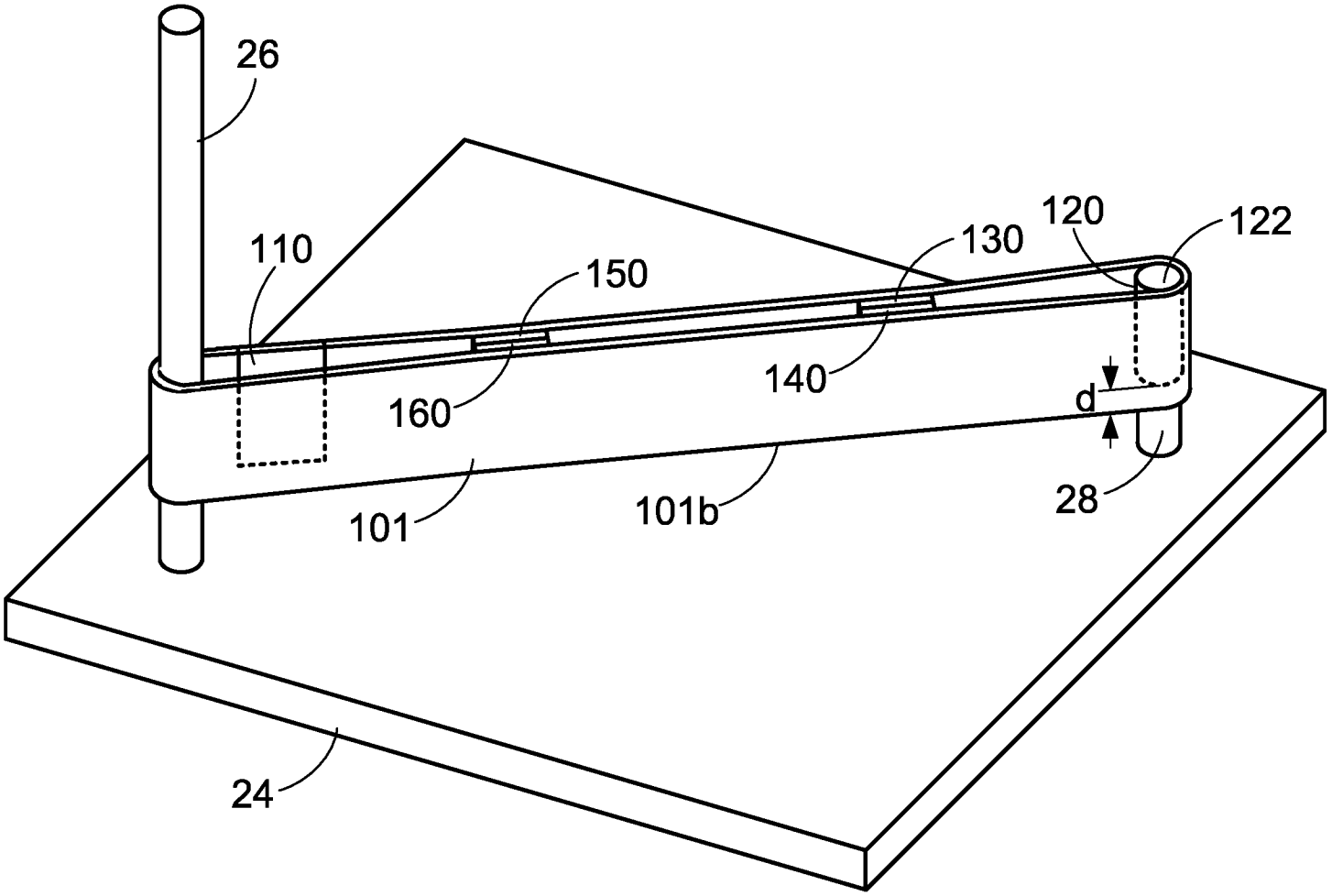
FIG. 6 shows a perspective view of the footrest strap assembled with the footrest of the wheelchair according to one embodiment of the present invention in use.
Figure 7:
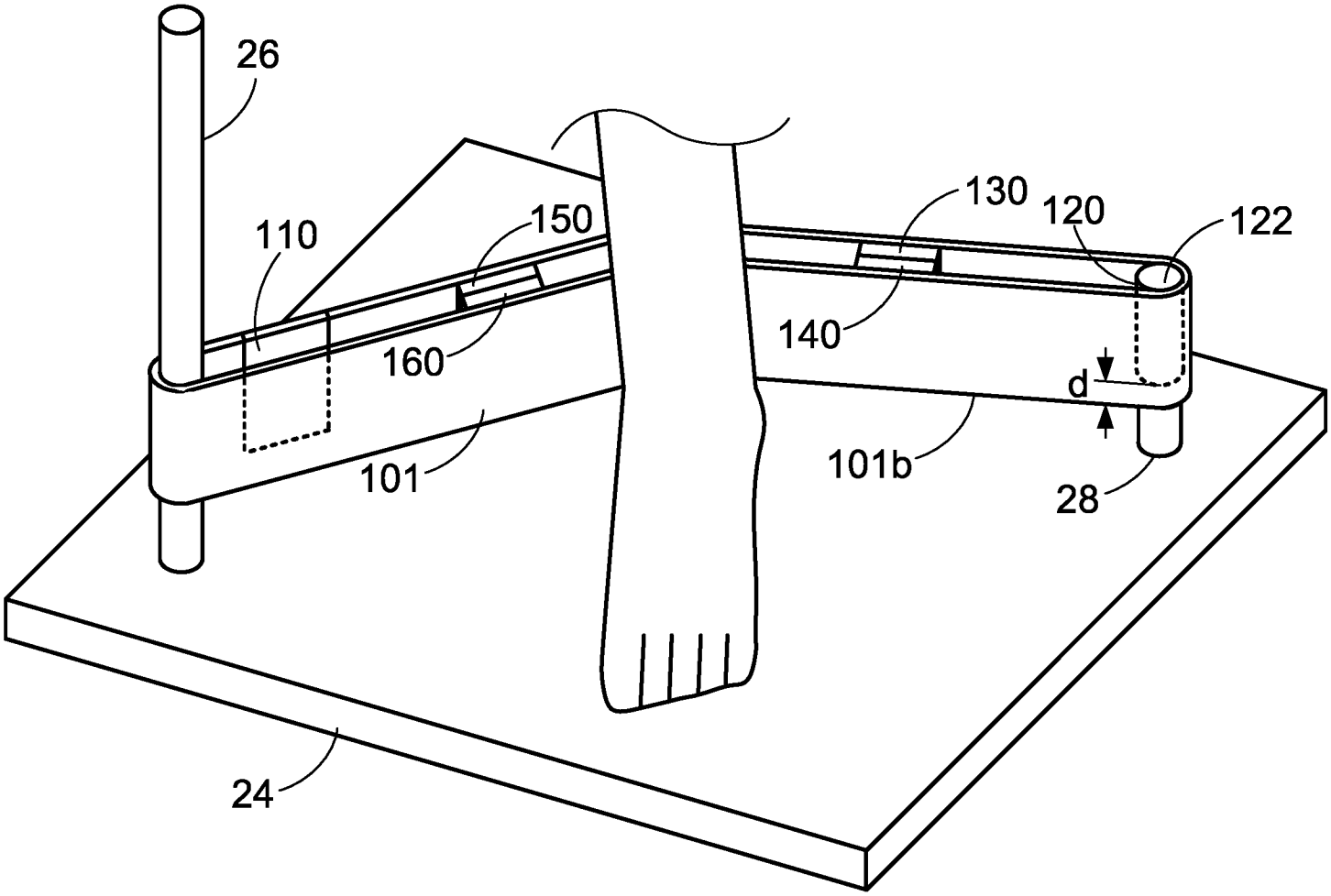
FIG. 7 shows a perspective view of the footrest strap and the footrest of the wheelchair in a first operation mode according to one embodiment of the present invention in use.
Figure 8:
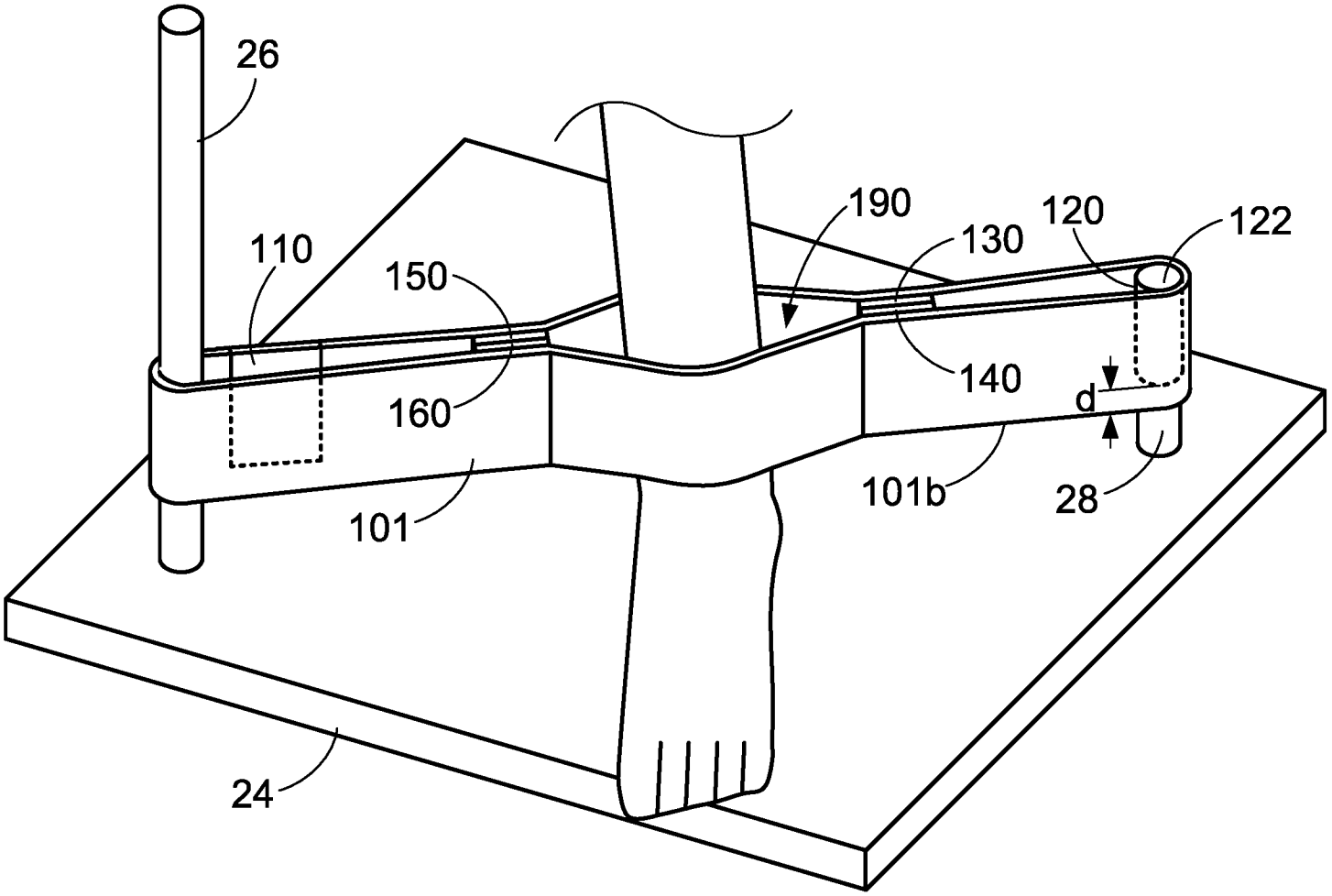
FIG. 8 shows a perspective view of the footrest strap and the footrest of the wheelchair in a second operation mode according to one embodiment of the present invention in use.

The footrest strap 100 of the present invention can be utilized in two different operation modes. In the first operation mode, referring to FIG. 7, a user can bend the body portion 101 of the footrest strap 100 and wrap it around the supporting pole 26 such that the supporting screw 28 is well received into the receptacle 120, the first fastening member 130 and the second fastening member 140 are fastened to each other, the third fastening member 150 and the fourth fastening member 160 are fastened to each other, the protruding member as the male interlocking member 112 and the buckle member as the female interlocking member 116 are coupled to each other to form the interlocking means 110, and the user can put a foot of the user against one side of the body portion 101 of the footrest strap 100, which is the conventional use of a footrest strap. The offset position 108 of the receptacle 120 or the distance Lc is chosen such that when the male interlocking member 112 and the female interlocking member 116 are coupled to each other to form the interlocking means 110, the interlocking means 110 is positioned away from the supporting pole 26, as shown in FIGS. 6-8, and on the side of the body portion 101 opposing the side of the strap against the foot of the user, as shown in FIGS. 7-8. Such design eliminates any direct contact between the foot of the user and the interlock means 110, thereby increasing the comfort level of the user. Furthermore, as shown in FIGS. 6-8, the second end 124 of the receptacle 120 is formed adjacent to the second side 101*b* of the body portion 101 with an offset distance d, which allows the supporting screw 28 to be easily slipped and slid into the space inside the receptacle 120 against the body portion 101 through the second end 124.

In the second operation mode, referring now to FIG. 8, a user can bend the body portion 101 to form an enclosed space 190 such that the supporting screw 28 is received into the receptacle 120, the protruding member as the male interlocking member 112 and the buckle member as the female interlocking member 116 are coupled to each other to form the interlocking means 100, and a foot of the user is positioned inside the enclosed space 190 formed by the bended body portion 101. Optionally, the first fastening member 130 and the second fastening member 140 may be fastened to each other, the third fastening member 150 and the fourth fastening member 160 may be fastened to each other, respectively, to provide additional support to the foot of the user. In this operation mode, the foot of the user is positioned, held and supported by the footrest strap inside the space 190, which offers comfort to the user and avoid unwanted swing or movement of the foot that may cause harm to the foot of the user. This operation mode is particularly useful for seniors or patients who use wheelchairs.

In summary, among other things, the footrest strap 100 of the present invention offers at least the following advantages over the conventional footrest strap:

Reusability. The footrest strap 100 of the present invention employs an interlocking means such as a clip-and-buckle mechanism to attach to the metal support pole and a slip-on flexible receptacle that allows the strap to be easily positioned onto the embedded supporting screw rather than taking the screw out altogether. The reusability aspect of the inventive footrest strap also allows for ease of cleaning and hygiene maintenance while conserving resources by reducing the need to repeatedly purchase and replace foot rest straps or the footrest itself.

Operational Efficiency. The ability to snap on and slip on the improved footrest strap to the footrest plate also decreases the time and labor needed to remove and replace the footrest strap from the footrest, making the strap more functional and pragmatic. Indeed, a user can adjust or replace the footrest strap of the present invention to meet the user's need without seeking help from a wheelchair repair shop. Moreover, the footrest strap of the present invention even makes the workers at a wheelchair repair shop work more efficiently and safely because no removing screws or cutting parts is needed.

Dual Use. The footrest strap 100 of the present invention can be used as a conventional footrest strap. It can also be used to position and hold the foot or feet of a user to avoid unwanted swing or movement of the foot that may cause harm to the foot of the user.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A footrest strap usable with a footrest of a wheelchair, wherein the footrest has a plate, a supporting pole, and a supporting screw across the plate from the supporting pole, comprising:

a body portion having a first end portion, a second end portion, and a center portion that is between the first end portion and the second end portion;

a male interlocking member formed at the first end portion;

a female interlocking member formed at the second end portion, wherein the male interlocking member and the female interlocking member are adapted to form an interlocking means;

a receptacle formed on the body portion at an offset position that is away from the center portion and between the center portion and the second end portion, wherein the receptacle has a first end and a second end, and wherein the second end is formed with an opening that is adapted for allowing the supporting screw to be introduced through the opening formed at the second end to be introduced into a space inside the receptacle in use;

a first fastening member formed on the body portion between the first end portion and the offset position; and a second fastening member formed on the body portion between the second end portion and the offset position, wherein the first fastening member and the second fastening member are positioned complimentarily to each other such that when in use the first fastening member and the second fastening member are fastened to each other.

2. The footrest strap of claim 1, further comprising:

a third fastening member formed on the body portion between the first end portion and the first fastening member; and a fourth fastening member formed on the body portion between the second end portion and the second fastening member, wherein the third fastening member and the fourth fastening member are positioned complimentarily to each other such that when in use the third fastening member and the fourth fastening member are fastened to each other.

3. The footrest strap of claim 2, wherein the first fastening member and the second fastening member are hook-loop fasteners complimentary to each other.

4. The footrest strap of claim 3, wherein the third fastening member and the fourth fastening member are hook-loop fasteners complimentary to each other.

5. The footrest strap as in claim 2, wherein the body portion is made of a continuous strip of pliable material.

6. The footrest strap as in claim 5, wherein the receptacle is formed with the first end either closed or opened.

7. The footrest strap as in claim 5, wherein the receptacle is formed with a material that is the same as or different from that of the body portion.

8. The footrest strap as in claim 7, wherein the receptacle is formed as an integral or separate part of the body portion.

9. The footrest strap as in claim 8, wherein the receptacle is formed with its edges sewn in place to the body portion.

10. The footrest strap of claim 9, wherein the pliable material is fabric, plastic or a combination of them.

11. The footrest strap of claim 9, wherein the receptacle is formed with the first end at a first side of the body portion, and the second end at or adjacent to an opposite second side of the body portion with an offset distance.

12. The footrest strap of claim 1, wherein the interlocking means comprises a clip-and-buckle mechanism.

13. The footrest strap of claim 12, wherein the clip-and-buckle mechanism comprises a protruding member as the male interlocking member and a buckle member as the female interlocking member adapted for coupling with the protruding member.

14. The footrest strap of claim 13, wherein in use the body portion is bended such that the supporting screw is received into the receptacle, the first fastening member and the second fastening member are fastened to each other, the protruding member as the male interlocking member and the buckle member as the female interlocking member are coupled to each other, and a foot of the user is positioned against one side of the body portion.

15. The footrest strap of claim 13, wherein in use the body portion is bended to form an enclosed space such that the supporting screw is received into the receptacle, the protruding member as the male interlocking member and the buckle member as the female interlocking member are coupled to each other, and a foot of the user is positioned inside the enclosed space formed by the bended body portion.

* * * * *